United States Patent [19]

Cambio et al.

[11] Patent Number: 4,727,347

[45] Date of Patent: Feb. 23, 1988

[54] TIME DELAY ELECTRICAL FUSE AND METHOD OF MAKING SAME

[75] Inventors: Dominic Cambio, Des Plaines; Michael E. Ross, Schaumburg; Richard Sperry, Elgin, all of Ill.

[73] Assignee: Reliance Fuse, Brush Fuses Inc., Des Plaines, Ill.

[21] Appl. No.: 941,620

[22] Filed: Dec. 15, 1986

[51] Int. Cl.[4] ..... H01H 71/20

[52] U.S. Cl. ..... 337/165; 337/163; 29/623

[58] Field of Search ..... 337/163, 164, 165, 166; 29/623

[56] References Cited

U.S. PATENT DOCUMENTS

| | | | |
|---|---|---|---|
| 2,577,531 | 12/1951 | Laing . | |
| 2,688,676 | 9/1954 | Laing . | |
| 2,688,677 | 9/1954 | Laing . | |
| 2,694,124 | 11/1954 | Laing et al. . | |
| 2,787,684 | 4/1957 | Laing . | |
| 3,253,104 | 5/1966 | Fister . | |
| 3,294,937 | 12/1966 | Kozacka . | |
| 3,854,111 | 12/1974 | Urani | 337/165 |
| 4,414,526 | 11/1983 | Panaro | 337/163 |
| 4,417,224 | 11/1983 | Ross | 337/164 |
| 4,533,895 | 8/1985 | Kowalik | 337/165 |
| 4,562,420 | 12/1985 | Kowalik | 337/165 |

FOREIGN PATENT DOCUMENTS 1173087 8/1984 Canada .

*Primary Examiner*—Harold Broome

*Attorney, Agent, or Firm*—Trexler, Bushnell, Giangiorgi & Blackstone, Ltd.

[57] ABSTRACT

The present invention relates generally to a three chamber ferrule type fuse comprising a tube of dielectric material having a tube wall and a bore, providing a unitary sub-assembly comprising a plunger and plunger guide, and two short circuit elements, a coil spring and a ring, having the tube wall staked forming a support for the ring inserting the sub-assembly into said bore of the tube so that one end thereof rests on said ring, having the coil spring under compression, and staking the sub-assembly in place. The construction facilitates assembly by automatic machinery.

8 Claims, 10 Drawing Figures

TIME DELAY ELECTRICAL FUSE AND METHOD OF MAKING SAME

BACKGROUND OF THE INVENTION

This invention relates to improvements in electrical fuses and more particularly to time delay fuses of the ferrule type.

Time delay fuses of the ferrule type have heretofore commonly comprised a cylindrical tube of insulating materials having caps which extend generally axially from the opposite ends of the tubes. Electrically connected between the caps within the tube is a series of longitudinally spaced short circuit elements and a thermal metallic mass of high heat conductivity constituting a structure that is heatable in a current overload connection. Examples of such fuses are found in U.S. Pat. Nos. 4,417,224; 4,414,526; and 4,562,420.

The present invention is concerned with a ferrule type fuse with three separate chambers spaced axially along the tube and forming the short circuit elements on each end of the overload chamber. Three chamber fuses have advantages in fuses of higher current and voltage ratings where more mass and break distance is required. In addition, the use of short circuit elements on each end of the overload section has the added advantage of better heat balance within the fuse and isolates the overload section from the ferrules which can develop hot spots due to poor contact between the ferrule and its mounting fuse clip. Thus, one feature of this invention is that it is adaptable to a wide range of voltage and current ratings for example current rating up to about 60 amps.

Another feature of the present invention is that it has a sub-assembly means which can be pre-assembled comprising a plunger and plunger guide with short circuit elements attached to the opposite ends of said plunger and plunger guide.

Another feature of this invention is that the use of fiber isolating washers are no longer needed to maintain the separate chambers. The overload chamber is closed off on one end by a close fit between the plunger and the tube. The other end of the overload chamber is closed off by a washer ring which rests on a support formed by stakes in the tube wall of the fuse.

Accordingly, it is an object of this invention to design a fuse of the ferrule type which can be assembled by a method that utilizes automatic machinery.

It is a more specific object of this invention to design a three compartment fuse of the ferrule type with a sub-assembly which comprises a plunger and plunger guide, and two short circuit elements, a compression spring and a ring which is designed so that it can be automatically assembled.

SUMMARY OF THE INVENTION

In accordance with the foregoing objects of the present invention a time delay fuse of the ferrule type comprising a tube of dielectric material having a tube wall and a bore, a unitary structure including a thermal mass having relative sliding parts with a solder joint therebetween; and short circuit elements; a first short circuit element means being attached to the thermal mass at one end thereof and a second short circuit element soldered to the thermal mass at an opposite end thereof, means forming a support in said bore, a ring on said support, a coil spring surrounding said thermal mass and supported at one end by said ring and at its other end by said thermal mass, means forming a fixed connection between the tube wall and said thermal mass for positioning said mass within said tube in a location therein at which the spring is maintained in compression such that a biasing force is applied to the thermal mass in opposition to the solder joint between one of said short circuit elements and said thermal mass and also in opposition to the solder joint between said parts of the thermal mass, whereby upon melting of said solder joint for said one short circuit element and the solder joint of said thermal mass, a part of said thermal mass will be urged by said spring away from said one short circuit element to break the physical and electrical connection of said thermal mass means and said one short circuit element.

In accordance with the method of the present invention a time delay fuse comprising providing an initially open-ended insulating tube that includes a tube wall and a bore, and a sub-assembly comprising a thermal mass and contact elements connected to said thermal mass and extending in opposite directions therefrom, forming a seat in said bore, inserting a compression spring into said bore so that one end thereof is supported by said seat, inserting said sub-assembly into said bore so that a portion thereof is supported by the other end of said compression spring, and compressing the spring by relative axial movement of the sub-assembly and tube, and then securing the sub-assembly in axially fixed relationship with tube wall to maintain the spring under compression and to fix the location of one of the sliding members.

DETAILED DESCRIPTION OF THE ILLUSTRATED EMBODIMENT

Figure 1:
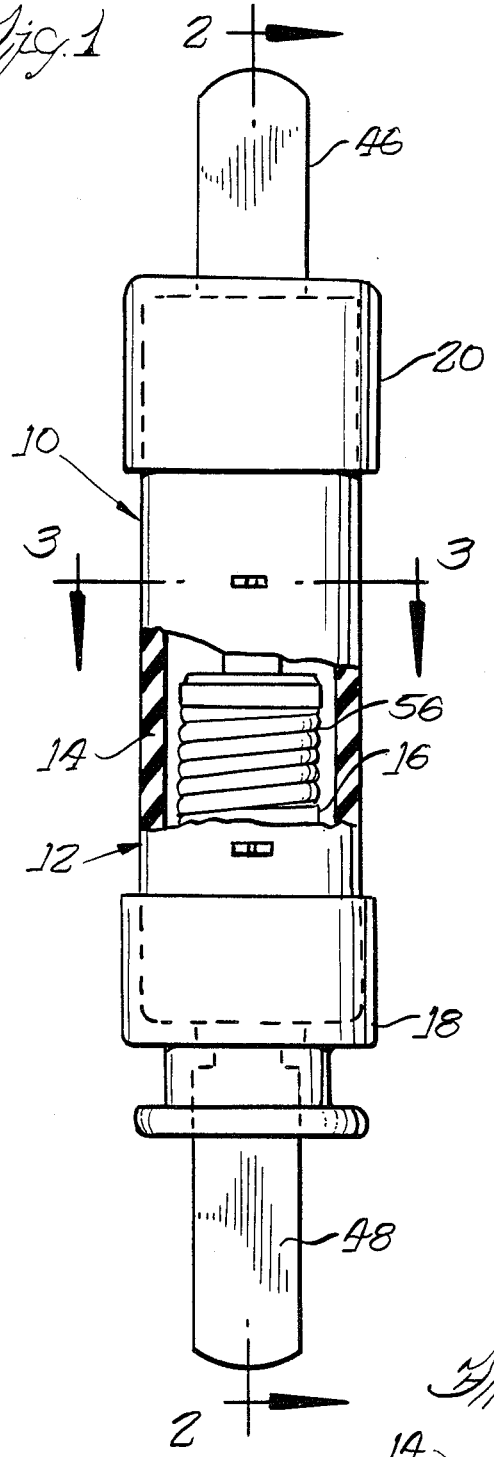
FIG. 1 is a partially broken away side elevational view of the time delay fuse constructed in accordance with and embodying the present invention.

Refering now to FIG. 1 the ferrule-type time delay fuse 10 there as shown includes a tube 12 of dielectric material or other suitable insulating material with a tube wall 14 and a bore 16. The tube 12 is closed at its ends by end caps 18 and 20 respectively. Physically and electrically connected to the end caps 18 and 20 is an all-metal sub-assembly 22 (as shown in FIG. 2).

Figure 2:
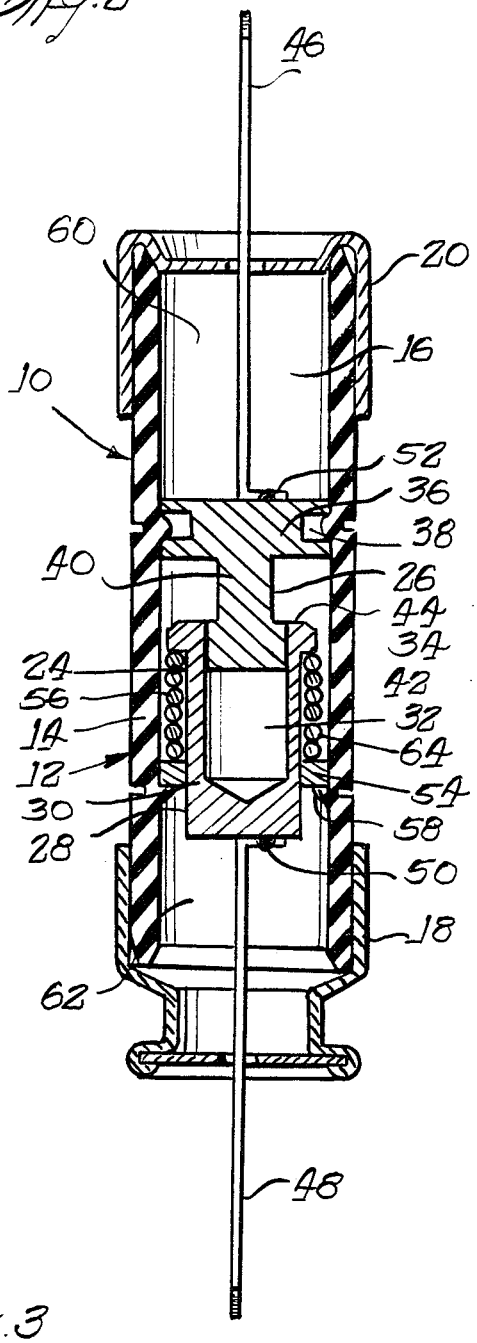
FIG. 2 is a sectional view of the time delay fuse taken approximately along the central axis of the fuse.
Figure 3:
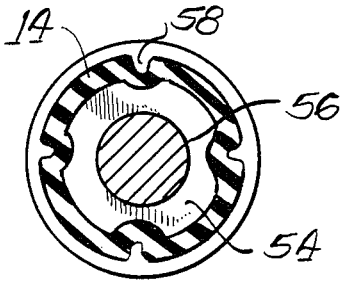
FIG. 3 is a sectional view of the time delay fuse taken along lines 3—3 in FIG. 1.
Figure 4:
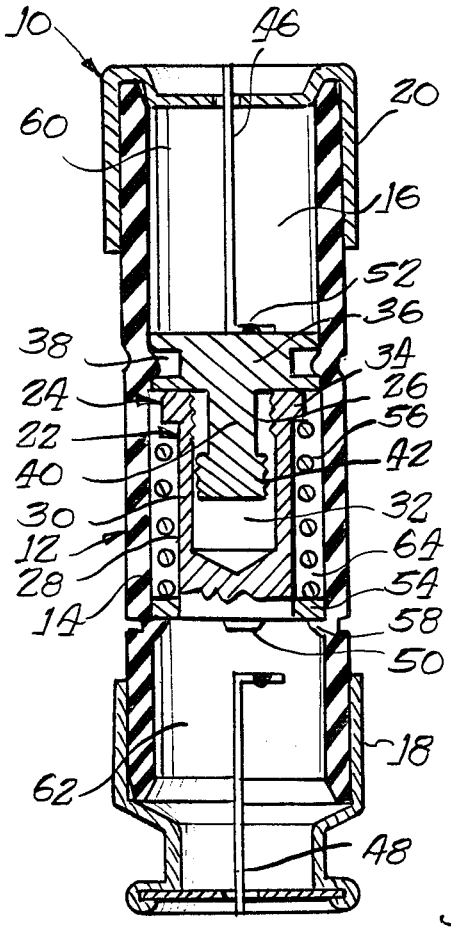
FIG. 4 is a sectional view showing the time delay fuse in a thermal overload condition resulting from excessive current.

Referring now to FIGS. 2, 3 and 4, the sub-assembly 22 is a unitary structure comprising a metal thermal mass 24 which includes a plurality of parts, namely a plunger 26 and plunger guide 28, both of which are preferably made of brass and are normally secured together. The plunger guide 28 has a cylindrical body portion 30 with a bore 32 and a radially outwardly projecting ledge member 34 at one end of the body 30. The plunger 26 has head member 36 and an axially extending body 40 and a radially enlarged section 42, which fits into the bore 32 to telescope with the plunger guide 28.

The plunger 26 and plunger guide 28 are secured together by heat fusible means such as solder at joint 44 which is the telescoping interface between the plunger and plunger guide. The sub-assembly also comprises conventional short-circuit elements 46 and 48 located at opposite ends of the thermal mass 24 and being substantially axially aligned relative to the tube. Short circuit element 46 is bent at one end and the bent end is attached to the plunger 26 at joint 52. Similarly short circuit element 48 has a bent end soldered to the plunger guide 28 at solder joint 50. The solder joints 50 and 44 should preferably have the same melting temperature at a value substantially below that of joint 52. By way of example but not of limitation, the solder at joints 50 and 44 will melt at about 296° F. while the connection at joint 52 may melt at 361° F.

As shown in FIGS. 2, 3 and 4 the tube wall 14 is staked in three or four places to inwardly deform the material of the tube wall to form a support 58 in the bore 16. A brass ring 54 is positioned on the support 58 forming a seat in surrounding relation to the plunger guide 28. One end of a coil spring 56 seats on the ring 54 and the opposite end of the spring 56 abuts the ledge member 34. During assembly of the fuse, as will hereinafter be described more fully, when the spring 56 is positioned in the bore 16 and rests on the ring 54 the sub-assembly 22 may be inserted into the bore 16 to compress the spring 56 to a predetermined point. Thereafter, the sub-assembly 22 may be staked. Subsequently, the tube wall 14 is staked into the plunger head 38 securing the sub-assembly in an axially fixed relationship to the tube 12 with the spring 56 compressed.

As shown in FIG. 4 when the sub-assembly 22 is in place in the tube 12 a first chamber 60 is formed between the plunger head 36 and one end of the tube 12. A second chamber 62 is formed between the ring 54 and the opposite end of the tube 12. The ring 54 is pressed against the seat 58 and serves with the plunger guide 28 to seal off effectively the chamber 62. A third chamber 64 is formed between the body of the thermal mass 24 and the tube wall 14. The two outermost chambers 60 and 62 are filled with an arc-quenching fill such as quartz or silica (not shown) in a conventional manner.

In operation current flows from one short circuit element 46 to short circuit element 48 through the thermal mass 24 in a normal manner until the current is sufficiently high that the heat is applied to the thermal mass 24. When the thermal mass heats it melts the solder at solder joints 50 and 44 (as shown in FIG. 2), whereby joints 50 and 44 assume the condition shown in FIG. 4. The joint 52 may not melt since it has a higher melting point than the 296° F. melting point of the solder joints 50 and 44.

A current overload condition which results in a melting of the solder joints 50, 44 cause the plunger guide 28 to slide relative to the plunger 26 due to the axially imposed force of the spring 56 (see FIG. 4) so that the plunger guide 28 will be pulled away from the element 48 to break the circuit. The arc-quenching in chamber 62 will aid quenching the arc.

The method in which the various parts of the fuse are assembled will now be described.

Figure 5:
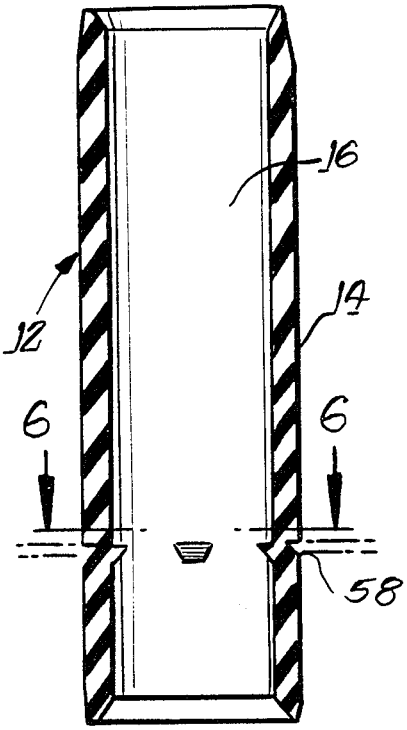
FIG. 5 shows an initial step in the assembly of the time delay fuse.
Figure 6:
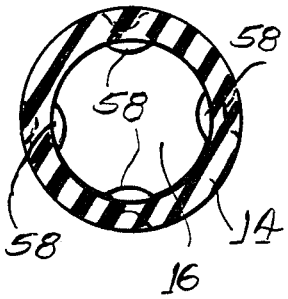
FIG. 6 is a sectional view of the time delay fuse taken along lines 6—6 in FIG. 5 showing the tube wall of the time delay fuse staked in three or four places.
Figure 8:
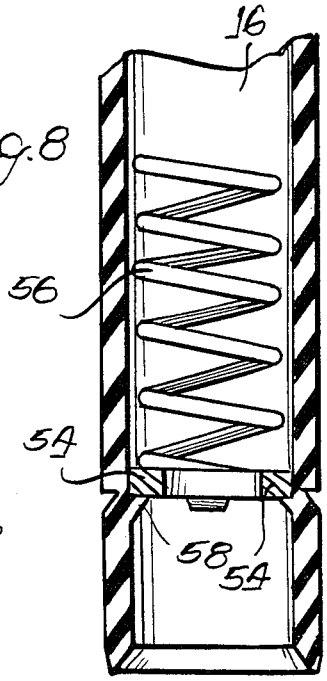
FIG. 8 is a fragmentary sectional view showing the compression spring as it is axially inserted into the bore of the tube and resting on the ring.
Figure 7:
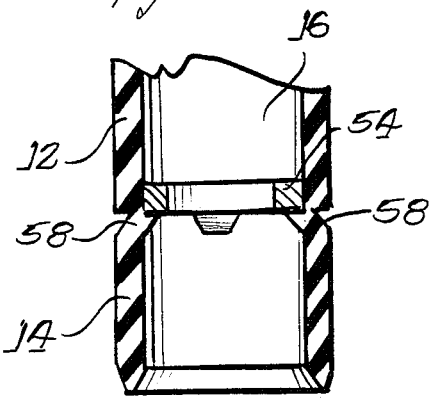
FIG. 7 is a fragmentary sectional view showing the ring resting on the stakes in the bore of the tube and illustrating a further step in the method.

As shown in FIGS. 5 and 6 a staking tool which may be part of a machine of known design is used to deform radially inwardly the tube wall 14 in three or four places to form the support 58. As shown in FIG. 7 during assembly of the fuse the ring 54 is inserted into an open end of the tube 12 and caused to rest on the support 58. Thereafter as shown in FIG. 8, the spring 56 is then axially inserted into an open-end of the tube to rest on the ring 54.

Figure 9:
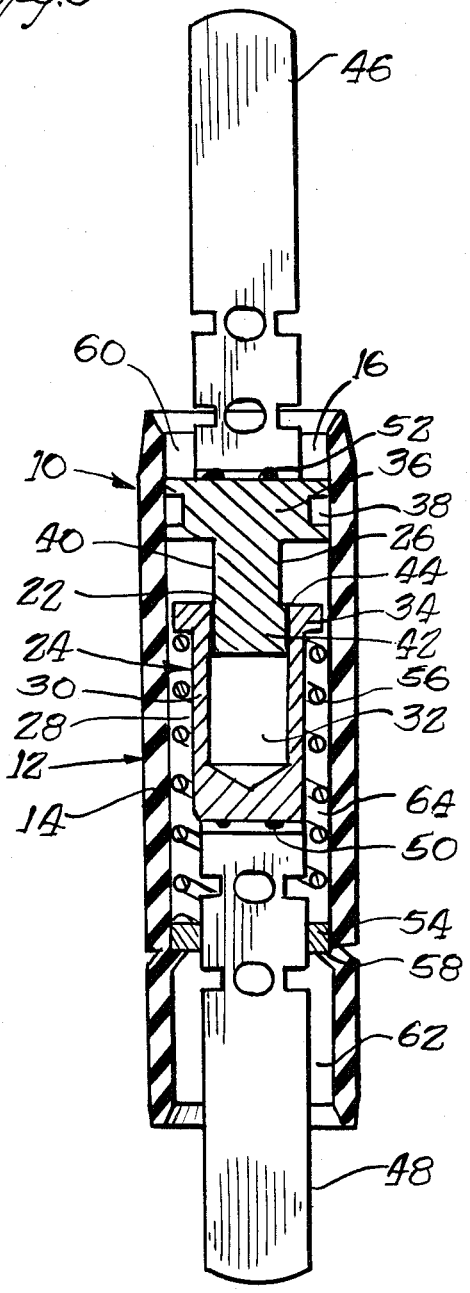
FIG. 9 is a side sectional view showing the sub-assembly inserted into bore of the time delay fuse.
Figure 10:
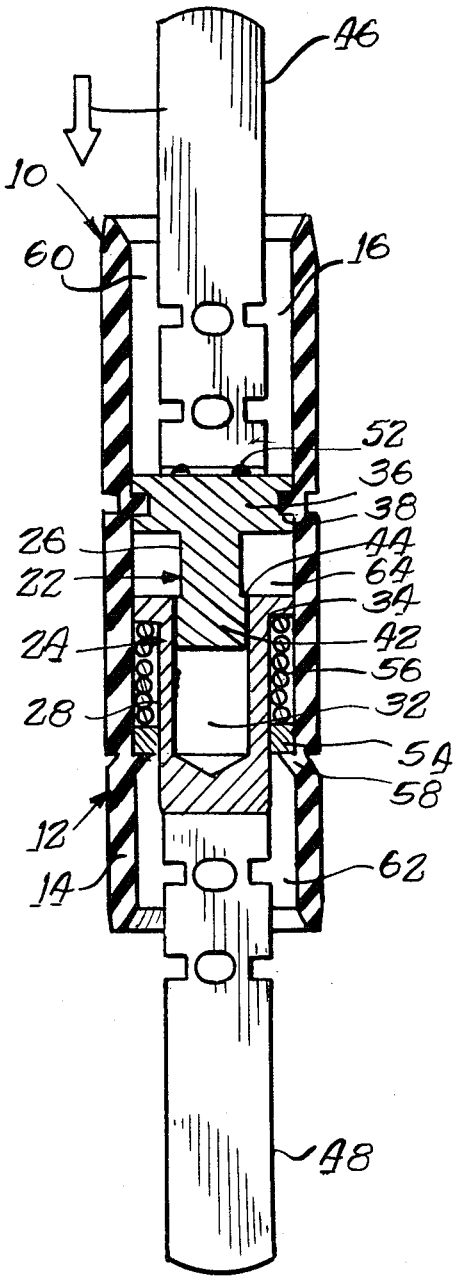
FIG. 10 shows the final step in the assembly of staking the tube of the time delay fuse into the plunger head.

As best shown in FIGS. 9 and 10 the sub-assembly or unitary structure 22 is inserted into one end of the bore 16 compressing the spring 56 the desired amount between the ring 54 and the ledge member 34 of the sub-assembly 22. A staking tool is then operated to radially inwardly deform the tube wall 14 into an annular groove 38 in the plunger head 36, securing the sub-assembly 22 against relative movement in the tube. The unitary structure can be pre-assembled and soldered together by well known means.

The various parts of the fuse 10 as described above require no orientation since all mating parts have round outer diameters or inner diameters with no slots or other shapes that require orientation for correct mating. The fact that the parts of the fuse 10 require no orientation enables the fuse 10 to be automatically assembled.

While particular embodiments of the invention have been shown and described it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

The invention is claimed as follows:

1. A time delay fuse of a ferrule type comprising a tube of dielectric material having a tube wall and a bore; a unitary structure in said bore and providing a thermal mass including a plunger part, a plunger guide part, and first and second short circuit elements; said plunger and plunger guide being in telescoped relationship, said first short circuit element being at an end of the plunger remote from said plunger guide, said second short circuit element being at an end of the plunger guide remote from said plunger, said short circuit elements being secured to the respective plunger and plunger guide by first and second heat fusible means, third heat fusible means securing said plunger and plunger guide together, means forming an axially presented seat in said bore; and a coil spring surrounding said unitary structure and supported at one end by said seat and at its other end by said unitary structure for positioning said unitary structure within said tube in a location therein at which the coil spring is maintained in compression such that a biasing force is applied to the unitary structure in opposition to said third heat fusible means and in opposition to one of said first and second heat fusible means such that upon melting of said one of said first and second heat fusible means and said third heat fusible means, a part of said thermal mass means will be urged by said spring away from the short circuit element associated with said one of said first and second heat fusible means to break the physical and electrical connection of said thermal mass and said associated short circuit element.

2. A time delay fuse of claim 1 wherein said tube wall has radially inwardly projecting deformations at circumferentially spaced points, and a ring is supported on said deformations and constituting said seat.

3. A time delay fuse of claim 1 wherein said unitary structure is pressed against said seat by said spring to form a wall portion of a first chamber between one end of said tube and a second chamber between said plunger and the opposite end of said tube, and a third chamber between the body of the thermal mass and said tube wall.

4. A time delay fuse of the ferrule type comprising a tube of dielectric material having a tube wall and a bore, a unitary structure including a thermal mass having relative sliding parts with a joint therebetween; and short circuit elements; a first short circuit element means being attached to the thermal mass at one end thereof and a second short circuit element connected to the thermal mass at an opposite end thereof, means forming a support in said bore, a ring on said support, a coil spring surrounding said thermal mass and supported at one end by said ring and at its other end by said thermal mass, means forming a fixed connection between the tube wall and said unitary structure for positioning said unitary structure within said tube in a location relatively axially therein at which the spring is maintained in compression such that a biasing force is applied to the thermal mass in opposition to the joint between one of said short circuit elements and said thermal mass and also in opposition to the joint between said parts of the thermal mass, whereby upon melting of said joint for said one short circuit element and the joint of said thermal mass, a part of said thermal mass will be urged by said spring away from said one short circuit element to break the physical and electrical connection of said thermal mass means and said one short circuit element.

5. A method of assembling a time delay fuse which comprises: providing a tube of dielectric material having a tube wall and a bore with a diameter that is large as compared to thickness of said tube wall, providing a unitary structure that forms a sub-assembly that includes an elongated structure having a plunger and a plunger guide in telescoped soldered-together coaxial relationship and short circuit elements secured to said plunger and plunger guide, respectively, and projecting in opposite directions, inserting a metallic ring in fixed position within the tube bore and by said ring forming a seat in said bore, inserting a compression spring into said bore so that one end thereof is supported by said seat, inserting said sub-assembly into said bore so that a portion thereof engages an end thereof, and compressing the spring between the sub-assembly and said ring by a relative axial movement between the sub-assembly and the tube, and then after the sub-assembly has been inserted into said tube and the spring compressed securing the sub-assembly in axially fixed relationship with the tube to maintain the spring under compression.

6. A method according to claim 5 in which said securing of the sub-assembly is effected by a staking operation that radially inwardly deforms the tube material into locking relation with the sub-assembly.

7. A method of assembling a time delay fuse comprising providing an initially open-ended insulating tube that includes a tube wall and a bore, and a sub-assembly comprising a thermal mass and contact elements soldered to said sub-assembly and extending in opposite directions therefrom, providing a seat in said bore, inserting a compression spring into said bore so that one end thereof is supported by said seat, inserting said sub-assembly into said bore so that a portion thereof is supported by the other end of said compression spring, and compressing the spring by relative axial movement of the sub-assembly and tube, and after the spring has been compressed securing the sub-assembly in axially fixed relationship with tube wall to maintain the spring under compression.

8. A method according to claim 7 in which said sub-assembly is secured to said tube by a staking operation that radially inwardly deforms the material of the tube into the sub-assembly.

* * * * *